US006614329B1

(12) United States Patent
Woods et al.

(10) Patent No.: US 6,614,329 B1
(45) Date of Patent: Sep. 2, 2003

(54) RADIO FREQUENCY/MICROWAVE/ MILLIMETERWAVE FILTER

(75) Inventors: Donnie W. Woods, Thousand Oaks, CA (US); Charles D. Pitcher, Thousand Oaks, CA (US)

(73) Assignee: Lucix Corporation, Camarillo, CA (US)

( * ) Notice: Subject to any disclaimer, the term of this patent is extended or adjusted under 35 U.S.C. 154(b) by 0 days.

(21) Appl. No.: 10/062,272

(22) Filed: Feb. 1, 2002

(51) Int. Cl.[7] ..... H01P 1/203
(52) U.S. Cl. ..... 333/204
(58) Field of Search ..... 333/175, 204, 333/205, 219, 134

(56) References Cited

U.S. PATENT DOCUMENTS 5,015,976 A * 5/1991 Saka ..... 333/204
5,977,847 A * 11/1999 Takahashi ..... 333/204
2002/0158704 A1 * 10/2002 Ye ..... 333/99 S

* cited by examiner

*Primary Examiner*—Seungsook Ham
(74) *Attorney, Agent, or Firm*—Blakely Sokoloff Taylor & Zafman LLP

(57) ABSTRACT

A low-pass filter comprises input and output transmission lines, a high impedance, series transmission line coupling the input and output transmission lines, a first meandered transmission line having one or more pairs of coupled transmission lines and one or more transition transmission lines connecting respective pairs of coupled transmission lines together, wherein one of the coupled transmission lines is connected to the input transmission line, and a second meandered transmission line having one or more pairs of coupled transmission lines and one or more transition transmission lines connecting respective pairs of coupled transmission lines together, wherein one of the coupled transmission lines is connected to the output transmission line. A high-pass filter is similar to the low-pass filter, except it has a pair of series coupled transmission lines in place of the series transmission line. The transmission lines are formed on a dielectric subtrate.

18 Claims, 10 Drawing Sheets

RADIO FREQUENCY/MICROWAVE/ MILLIMETERWAVE FILTER

FIELD OF THE INVENTION

This invention relates generally to radio frequency (RF)/ microwave/millimeter wave devices, and in particular, to a single-stage, low-pass filter, single-stage, high-pass filter, low-pass filter comprising a plurality of single-stage, low-pass filters, high-pass filter comprising a plurality of single-stage, high-pass filters, and a band-pass filter or other types of filters comprising any combination of one or more single-stage, low-pass filters and one or more single-stage, high-pass filters.

BACKGROUND OF THE INVENTION

Filters are used extensively for RF/microwave/ millimeterwave applications. For example, filters are used to remove higher frequency products from a down-converted signal, to remove lower frequency products from an up-converted signal, to remove harmonics, spurious and other unwanted signals from the output of a local oscillator.

Certain characteristics are generally desirable of filters. For instance, it is generally desirable for filters to have relatively low insertion and return loss within its pass band, yet relatively high rejection and return loss within its reject band. It is also generally desirable to have filters that can be implemented efficiently within a given space. Additionally, it is generally desirable to have filters that can be easily designed and manufactured. For example, it is generally desirable to have filters that can be easily scaled in size for other frequencies.

Such needs and others are met with the various filters described herein in accordance with the invention.

SUMMARY OF THE INVENTION

An aspect of the invention relates to a single-stage, low-pass filter. The single-stage, low-pass filter comprises input and output transmission lines, a series transmission line having a first end connected to the input transmission line and a second end connected to the output transmission line, a first meandered transmission line comprising at least two electromagnetically coupled transmission lines and at least one transition transmission line connecting together respective pairs of coupled transmission lines wherein one of the coupled transmission lines includes an end coupled to the input transmission line, and a second meandered transmission line comprising at least two coupled transmission lines and at least one transition transmission line connecting together respective pairs of coupled transmission lines wherein one of the coupled transmission lines is connected to the output transmission line. All of the above transmission lines can be formed on one or more dielectric substrates.

Another aspect of the invention relates to a single-stage, high-pass filter. The single-stage, high-pass filter comprises input and output transmission lines, and a pair of series coupled transmission lines, wherein one of the series coupled transmission lines is coupled to the input transmission line and the other series coupled transmission line is coupled to the output transmission line. The single-stage, high-pass filter further comprises a first meandered transmission line comprising at least two coupled transmission lines and at least one transition transmission line connecting together respective pairs of coupled transmission lines wherein one of the coupled transmission lines is coupled to the input transmission line, and a second meandered transmission line comprising at least two coupled transmission lines and at least one transition transmission line connecting together respective pairs of coupled transmission lines wherein one of the second coupled transmission lines is connected to the output transmission line. All of the above transmission lines can be formed on one or more dielectric substrates.

Other aspects of the invention include a low-pass filter comprising a plurality of single-stage, low-pass filters coupled in series, a high-pass filter comprising a plurality of single-stage, high-pass filters coupled in series, a band-pass filter comprising a combination of one or more single-stage, low-pass filters and one or more single-stage, high-pass filters, and any other types of filters that comprise one or more single-stage, low-pass filters and/or one or more single-stage, high-pass filters. Other aspects, features and techniques of the invention will become apparent to one skilled in the relevant art in view of the following detailed description of the invention.

DETAILED DESCRIPTION OF THE INVENTION

Figure 1A:
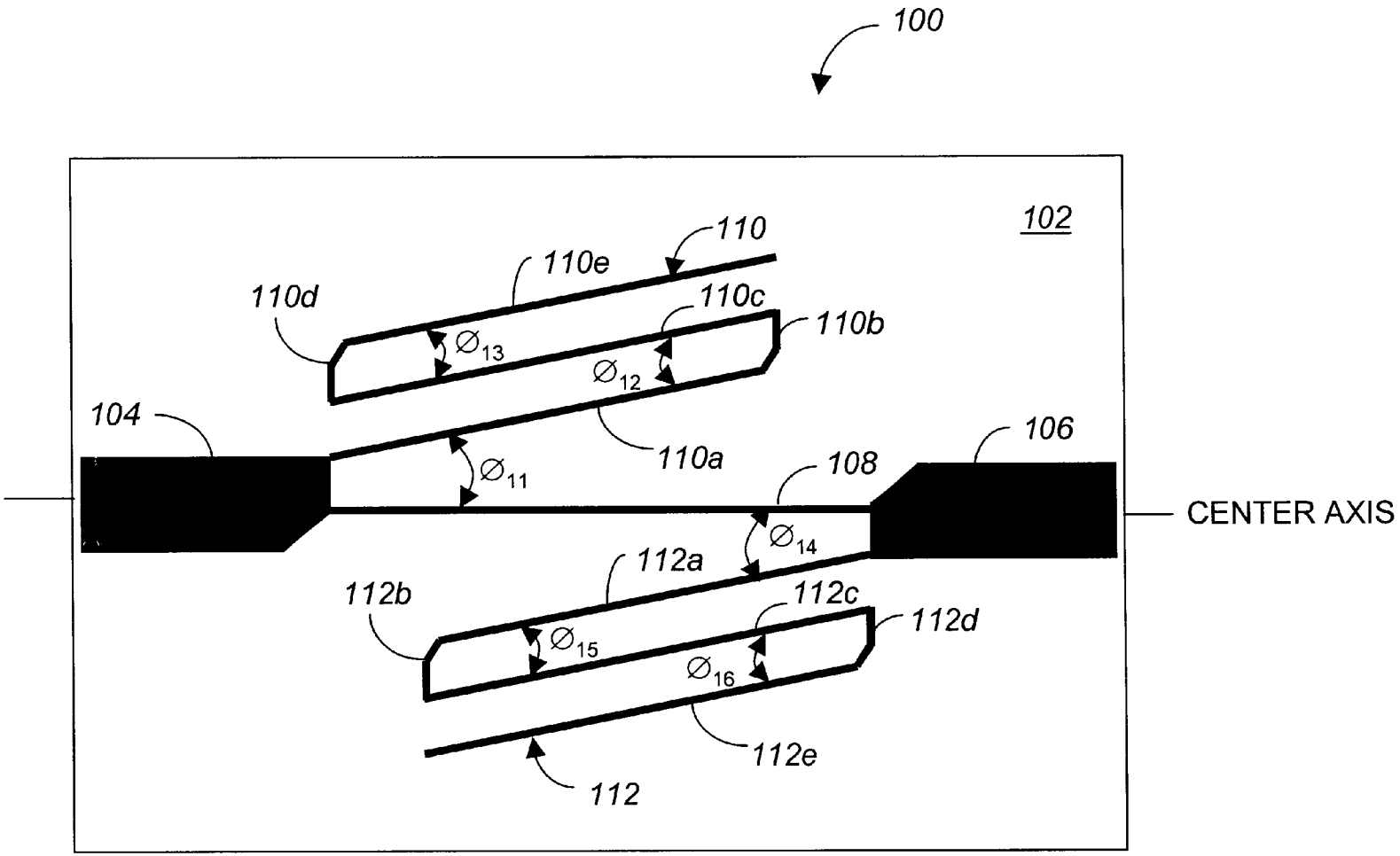
FIG. 1A illustrates a plane view of an exemplary single-stage, low-pass filter in accordance with the invention.

FIG. 1A illustrates a plane view of an exemplary single-stage, low-pass filter 100 in accordance with the invention. The filter 100 comprises a substrate 102, an input transmission line 104, an output transmission line 106, a series high impedance transmission line 108 connected at one end to the input transmission line 104 and at the other end to the output transmission line 106. The single-stage, low-pass filter 100 further comprises a first meandered transmission line 110 connected at one end to the input transmission line 104 and the other end being open. In addition, the single-stage, low-pass filter 100 comprises a second meandered transmission line 112 connected at one end to the output transmission line 106 and the other end being open.

The series transmission line 108 may have a characteristic impedance substantially greater than the characteristic impedance of the input and output transmission lines 104 and 106. For example, the characteristic impedance of the series transmission line 108 may be in the range from about 70 to 100 Ohms, whereas the characteristic impedance of the input and output transmission lines 104 and 106 may be about 50 Ohms. The length of the series transmission line 108 may depend on the desired frequency response for the low-pass filter 100, but generally the length is about one-twelfth wavelength at the corner frequency of the low-pass filter 100.

The first meandered transmission line 110 comprises a plurality of electromagnetically coupled sections 110*a,* 110*c,* and 110*e,* and transition sections 110*b* and 110*d.* Transition section 110*b* has ends connected respectively to corresponding ends of coupled sections 110*a* and 110*c.* Transition section 110*d* has ends connected respectively to corresponding ends of coupled sections 110*c* and 110*e.* The transition sections 110*b* and 110*d* may each comprise two bends of approximately 90 degrees each at respective ends of a relatively short transmission line. The first section 110*a* of the first meandered transmission line 110 may be electromagnetically coupled to the series transmission line 108 and to the second section 110*c* of the first meandered transmission line 110. Likewise, the second section 110*c* of the first meandered transmission line 110 may be electromagnetically coupled to the first section 110*a* and to the third section 110*e* of the first meandered transmission line 110.

The first meandered transmission line 110 may have a characteristic impedance substantially greater than the characteristic impedance of the input and output transmission lines 104 and 106. For example, the characteristic impedance of the first meandered transmission line 110 may be in the range from about 70 to 100 Ohms, whereas the characteristic impedance of the input and output transmission lines 104 and 106 may be about 50 Ohms. The length of each of the sections of the first meandered transmission line 110 may depend on the desired frequency response for the low-pass filter 100. Likewise, the angle $\phi_{11}$ between the series transmission line 108 and the first section 110*a* of the first meandered transmission line 110, the angle $\phi_{12}$ between the first section 110*a* and the second section 110*c* of the first meandered transmission line 110, and the angle $\phi_{13}$ between the second section 110*c* and the third section 110*e* of the first meandered transmission line 110 may depend on the desired frequency response for the low-pass filter 100.

The second meandered transmission line 112 comprises a plurality of electromagnetically coupled sections 112*a,* 112*c,* and 112*e,* and transition sections 112*b* and 112*d.* Transition section 112*b* has ends connected respectively to corresponding ends of coupled sections 112*a* and 112*c.* Transition section 112*d* has ends connected respectively to corresponding ends of coupled sections 112*c* and 112*e.* The transition sections 112*b* and 112*d* may each comprise two bends of approximately 90 degrees at respective ends of a relatively short transmission line. The first section 112*a* of the second meandered transmission line 112 may be electromagnetically coupled to the series transmission line 108 and to the second section 112*c* of the second meandered transmission line 112. Likewise, the second section 112*c* of the second meandered transmission line 112 may be electromagnetically coupled to the first section 112*a* and to the third section 112*e* of the second meandered transmission line 112.

The second meandered transmission line 112 may have a characteristic impedance substantially greater than the characteristic impedance of the input and output transmission lines 104 and 106. For example, the characteristic impedance of the second meandered transmission line 112 may be in the range from about 70 to 100 Ohms, whereas the characteristic impedance of the input and output transmission lines 104 and 106 may be about 50 Ohms. The length of each of the sections of the second meandered transmission line 112 may depend on the desired frequency response for the low-pass filter 100. Likewise, the angle $\phi_{14}$ between the series transmission line 108 and the first section 112*a* of the second meandered transmission line 112, the angle $\phi_{15}$ between the first section 112*a* and the second section 112*c* of the second meandered transmission line 112, and the angle $\phi_{16}$ between the second section 112*c* and the third section 112*e* of the second meandered transmission line 112 may depend on the desired frequency response for the low-pass filter 100.

Generally, it is desirable for the single-stage, low-pass filter 100 to be substantially symmetrical about the center axis extending as a straight line from the middle of the input transmission line 104 to the middle of the output transmission line 106. Thus, the lengths of the sections 110*a–e* of the first meandered transmission line 110 are substantially equal to the respective lengths of the sections 112*a–e* of the second transmission line 112. Also, the angles $\phi_{11}$, $\phi_{12}$, $\phi_{13}$ between the first section 110*a* of the first meandered transmission line 110 and the series transmission line 108 and between the respective coupled sections 110*a,* 110*c* and 110*e* of the first meandered transmission line 110 are substantially equal to respective angles $\phi_{14}$, $\phi_{15}$, and $\phi_{16}$ between the first section 112*a* of the second meandered transmission line 112 and the series transmission line 108 and between the respective coupled sections 112*a,* 112*c* and 112*e* of the second transmission line 112.

The various parameters of the single-stage, low-pass filter 100 may be selected to obtain a desired frequency response for the stage. These parameters may include the length and width (i.e. characteristic impedance) of the series transmission line 108, the lengths and associated angles $\phi_{11}$, $\phi_{12}$, and $\phi_{13}$ of the respective sections 110*a–e* of the first meandered transmission line 110, and the lengths and associated angles $\phi_{14}$, $\phi_{15}$, and $\phi_{16}$ of the respective sections 112*a–e* of the second meandered transmission line 112.

Figure 1B:
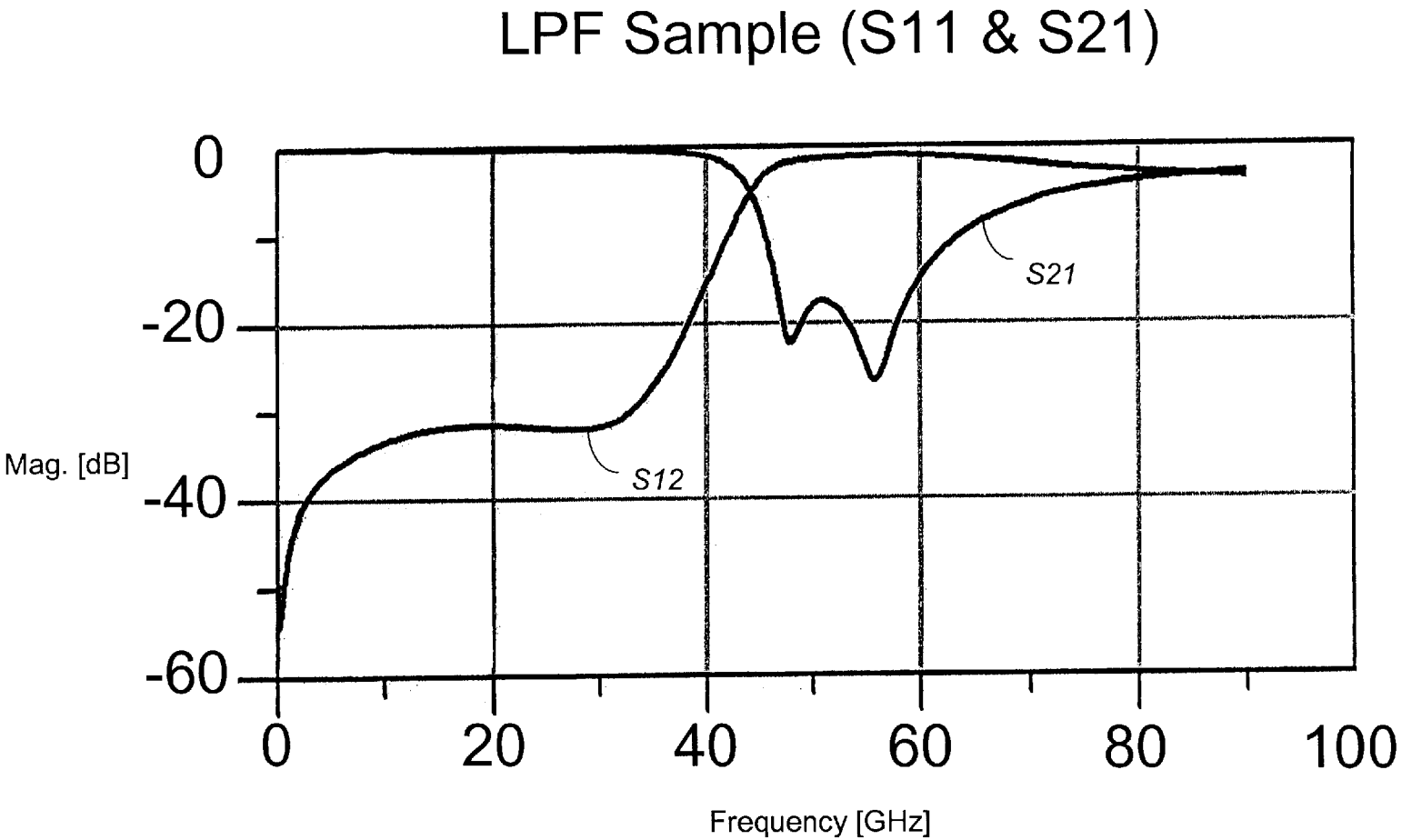
FIG. 1B illustrates a graph of an exemplary frequency response of the single-stage, low-pass filter in accordance with the invention.

FIG. 1B illustrates a graph of an exemplary frequency response of the single-stage, low-pass filter 100 in accordance with the invention. The x-axis of the graph depicts frequency ranging from 0 Hz to 100 GHz. The y-axis depicts magnitude for both insertion loss (i.e. S21 parameter) and return loss (i.e. S11 parameter) ranging from 0 dB to −60 dB. Both the insertion loss parameter S21 and the return loss parameter S11 are illustrated in the graph. The graph shows that the insertion loss S21 of the low-pass filter 100 is substantially nil from about 0 Hz to about 40 GHz (i.e. the pass band) with a return loss S11 better than −30 dB from about 0 Hz to 36 GHz and rolls off to about −18 dB at 40 GHz. The out-of-band rejection is approximately 20 dB from about 48 GHz to 60 GHz.

Figure 2A:
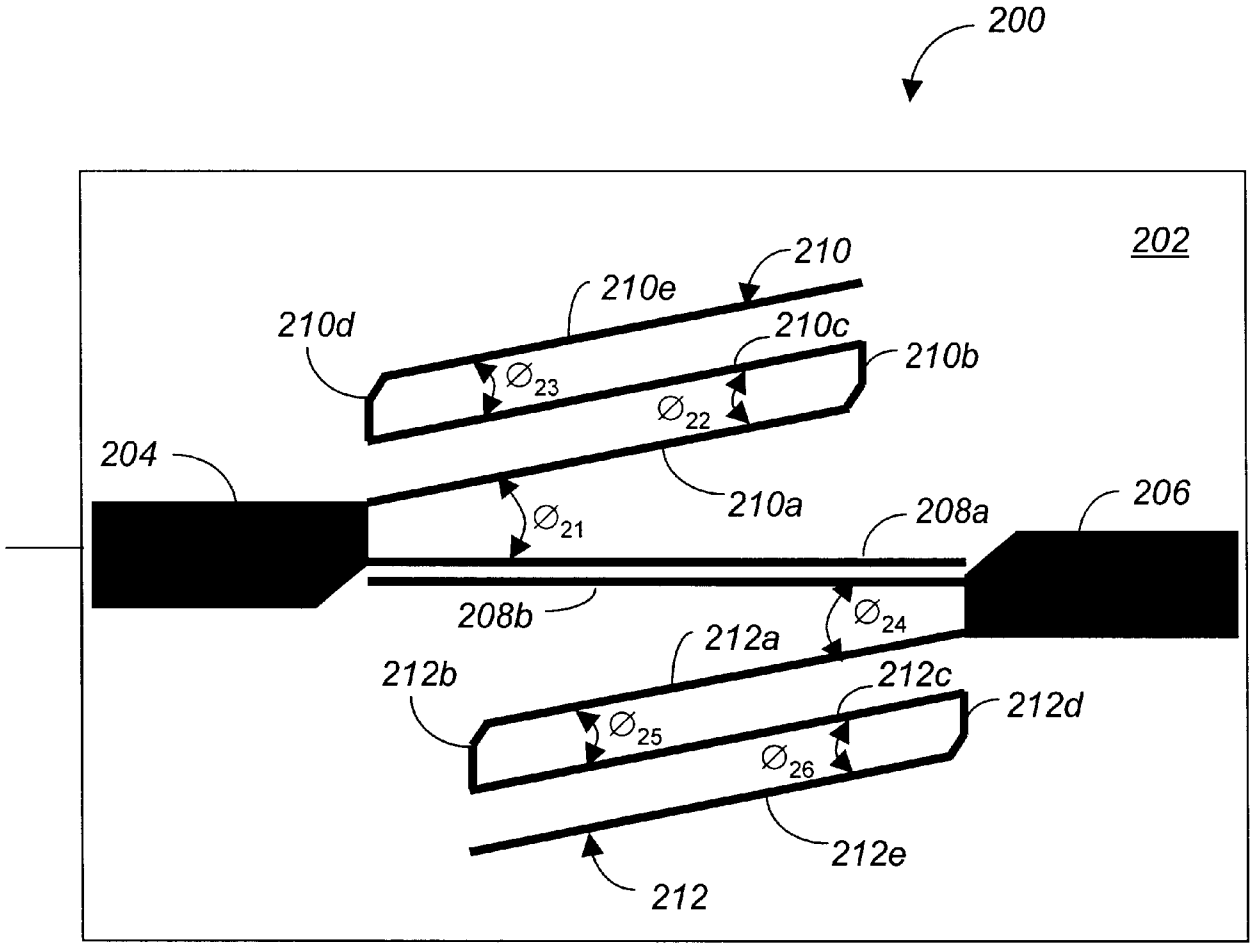
FIG. 2A illustrates a plane view of an exemplary single-stage, high-pass filter in accordance with the invention.

FIG. 2A illustrates a plane view of an exemplary single-stage, high-pass filter 200 in accordance with the invention. The filter 200 comprises a substrate 202, an input transmission line 204, an output transmission line 206, a series electromagnetically coupled transmission lines 208*a–b* having an end of coupled transmission line 208*a* connected to the input transmission line 204 and an end of coupled transmission line 208*b* connected to the output transmission line 206. The single-stage, high-pass filter 200 further comprises a first meandered transmission line 210 connected at one end to the input transmission line 204 and the other end being open. In addition, the single-stage, high-pass filter 200 comprises a second meandered transmission line 212 having an end connected to the output transmission line 206 and the other end being open.

The series coupled transmission lines 208 have a characteristic impedance substantially greater than the characteristic impedance of the input and output transmission lines 204 and 206. For example, the characteristic impedance of the series coupled transmission lines 208 may be in the range from about 70 to 100 Ohms, whereas the characteristic impedance of the input and output transmission lines 204 and 206 may be about 50 Ohms. The length of the series coupled transmission lines 208 may depend on the desired frequency response for the high-pass filter 200, but generally the length is about one-eighth wavelength at the corner frequency of the high-pass filter 200.

The first and second meandered transmission lines 210 and 212 of the high-pass filter 200 are similar to the first and second meandered transmission lines 110 and 112 of the low-pass filter 100, yet designed for the desired frequency response for the high-pass filter 200. Thus, the various parameters of the single-stage, high-pass filter 200 may be selected to obtain a desired frequency response. These parameters may include the respective lengths, widths, and spacing (i.e. characteristic impedance) of the series coupled transmission lines 208, the lengths and associated angles $\phi_{21}$, $\phi_{22}$, and $\phi_{23}$ of the respective sections 210*a–e* of the first meandered transmission line 210, and the lengths and associated angles $\phi_{24}$, $\phi_{25}$, and $\phi_{26}$ of the respective sections 212*a–e* of the second meandered transmission line 212.

Figure 2B:
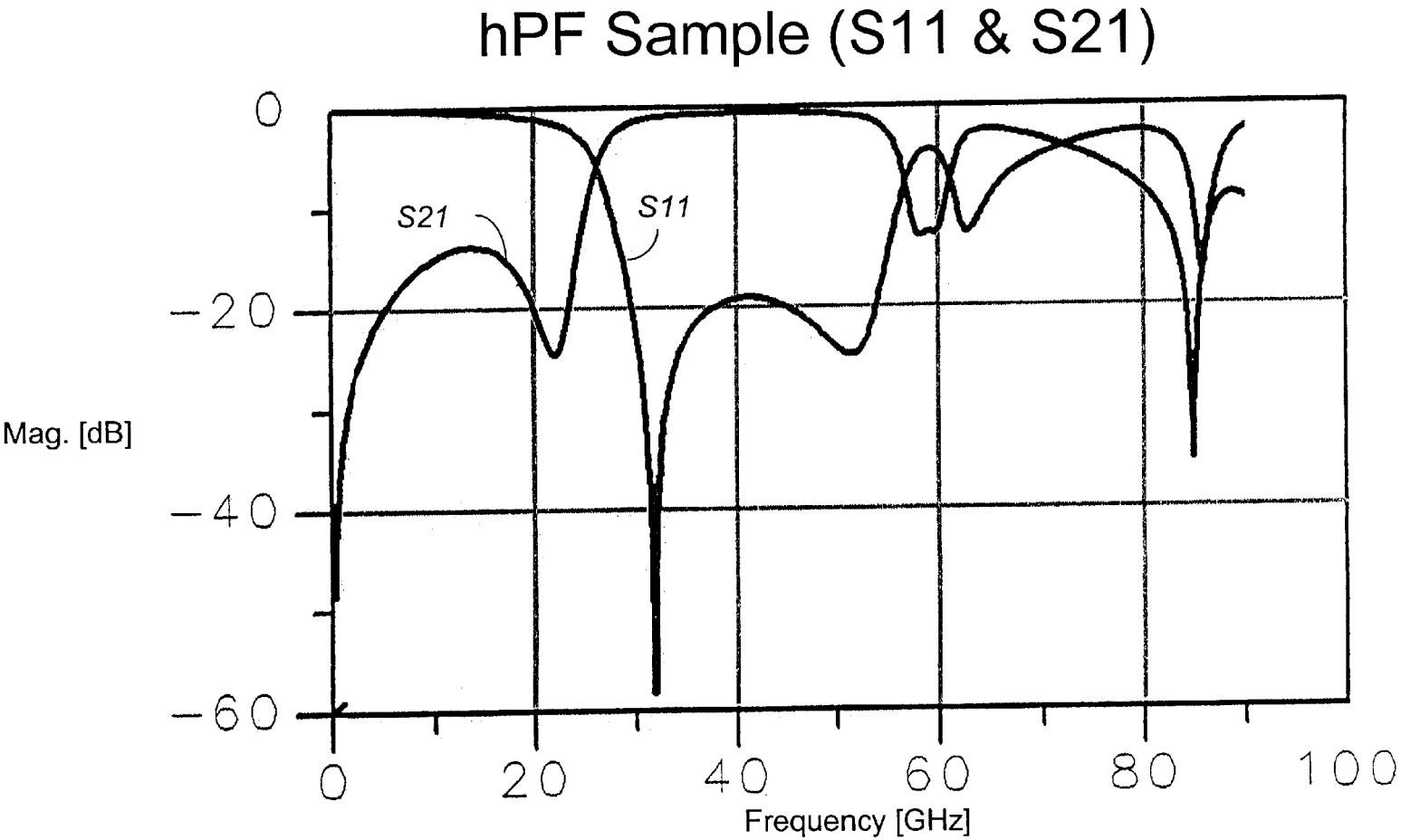
FIG. 2B illustrates a graph of an exemplary frequency response of the single-stage, high-pass filter in accordance with the invention.

FIG. 2B illustrates a graph of an exemplary frequency response of the single-stage, high-pass filter 200 in accordance with the invention. The x-axis of the graph depicts frequency ranging from 0 Hz to 100 GHz. The y-axis depicts magnitude for both insertion loss (i.e. S21 parameter) and return loss (i.e. S11 parameter) ranging from 0 dB to −60 dB. Both the insertion loss parameter S21 and the return loss parameter S11 are illustrated in the graph. The graph shows that the insertion loss S21 of the high-pass filter 200 is less than about 1 dB from about 30 GHz to about 46 GHz (i.e. the pass band) with a return loss S11 of about −20 dB or better. The out-of-band rejection is approximately 14 dB or better from about 0 Hz to 25 GHz.

Figure 3A:
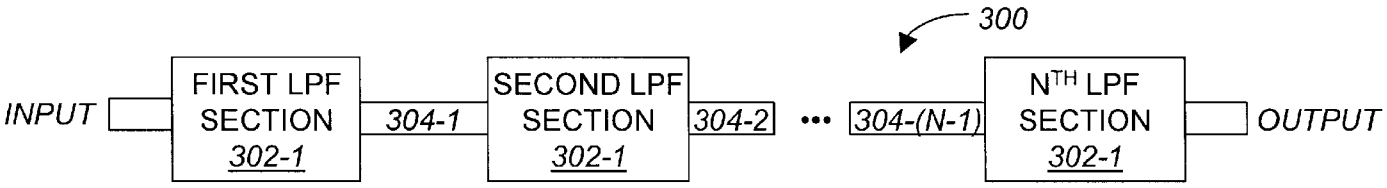
FIG. 3A illustrates a block diagram of an exemplary, low-pass filter in accordance with the invention.
Figure 3B:
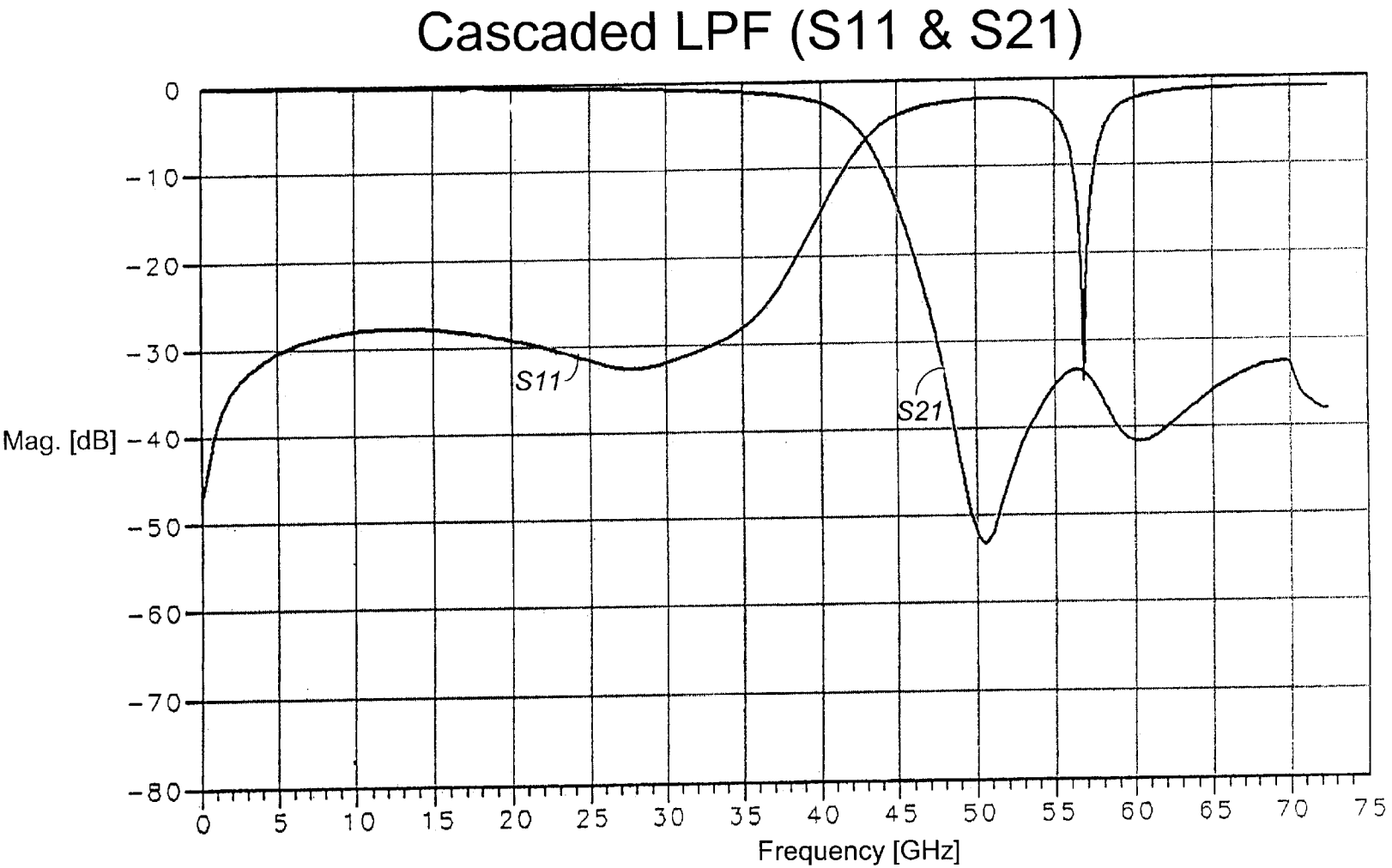
FIG. 3B illustrates a graph of an exemplary frequency response of the low-pass filter of the invention.

FIG. 3A illustrates a block diagram of an exemplary low-pass filter 300 in accordance with the invention. The low-pass filter 300 comprises two or more single-stage, low-pass filters 302-1-N of the type described with reference to single-stage, low-pass filter 100. The single-stage, low-pass filters 302-1-N may be coupled to each other by way of respective transmission lines 304-1-(N−1). The respective parameters of the single-stage, low-pass filters 302-1-N may be designed along with the respective parameters (lengths and characteristic impedances) of the transmission lines 304-1-(N−1) to achieve a desired overall frequency response for the low-pass filter 300. FIG. 3B illustrates a graph of an exemplary frequency response of the multi-stage low-pass filter 300.

Figure 4A:
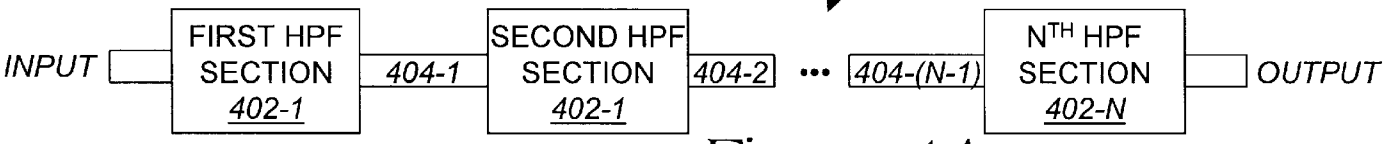
FIG. 4A illustrates a block diagram of an exemplary high-pass filter in accordance with the invention.
Figure 4B:
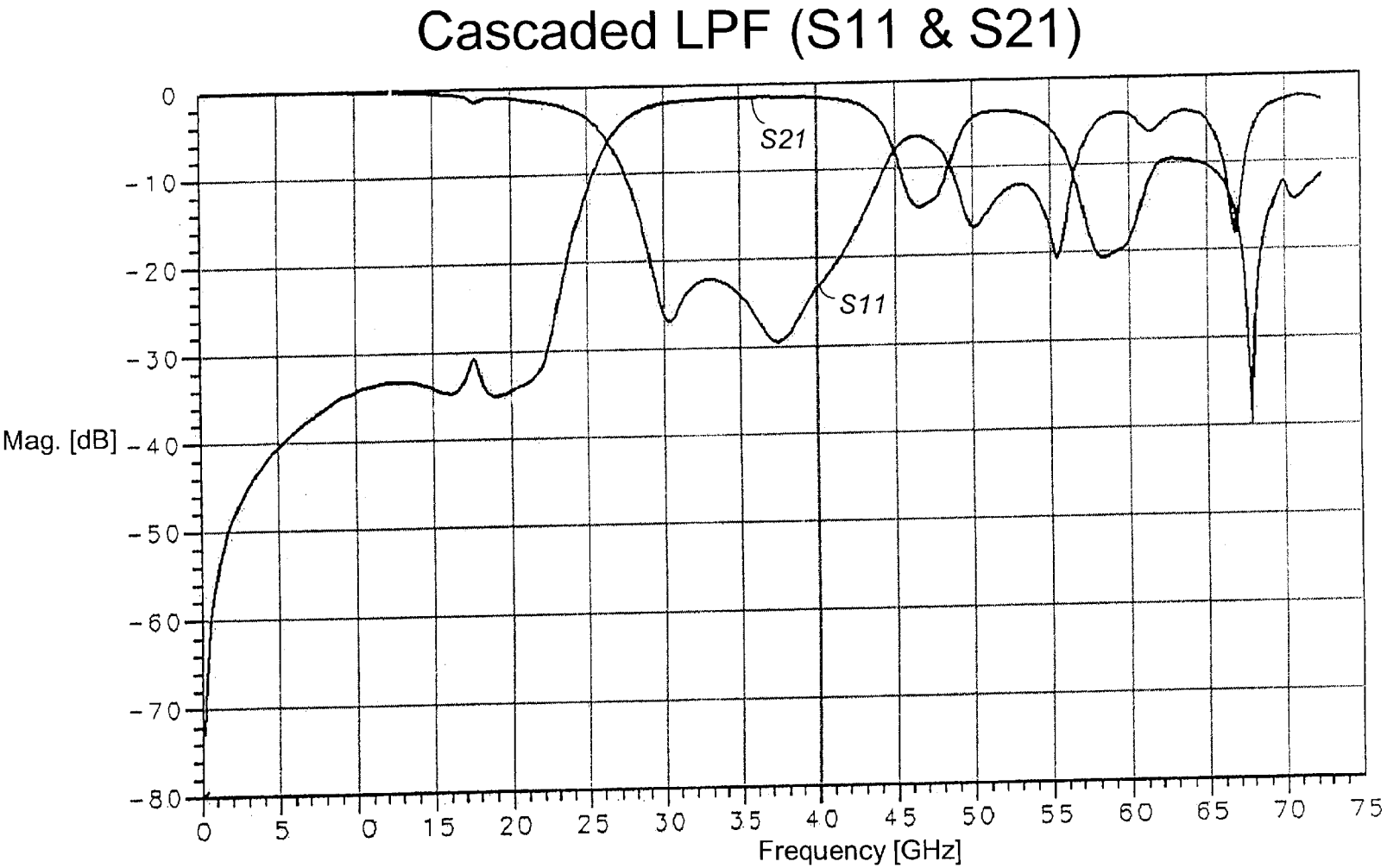
FIG. 4B illustrates a graph of an exemplary frequency response of the high-pass filter of the invention.

FIG. 4A illustrates a block diagram of an exemplary high-pass filter 400 in accordance with the invention. The high-pass filter 400 comprises two or more single-stage, high-pass filters 402-1-N of the type described with reference to single-stage, high-pass filter 200. The single-stage, high-pass filters 402-1-N may be coupled to each other by way of respective transmission lines 404-1-(N−1). The respective parameters of the single-stage, high-pass filters 402-1-N may be designed along with the respective parameters (lengths and characteristic impedances) of the transmission lines 404-1-(N−1) to achieve a desired overall frequency response for the high-pass filter 400. FIG. 4B illustrates a graph of an exemplary frequency response of the multi-stage high-pass filter 400.

Figure 5A:
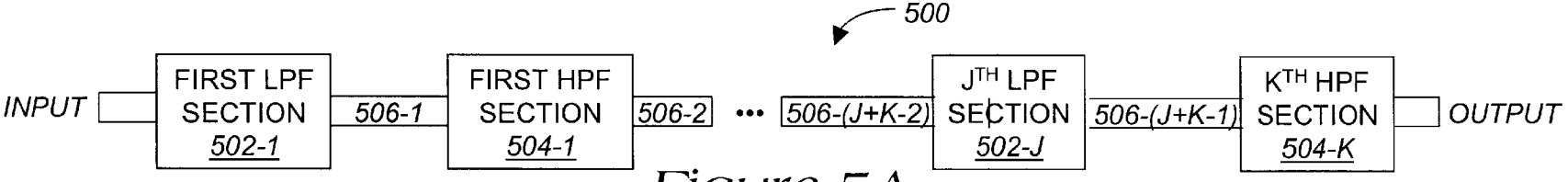
FIG. 5A illustrates a block diagram of an exemplary band-pass filter in accordance with the invention.
Figure 5B:
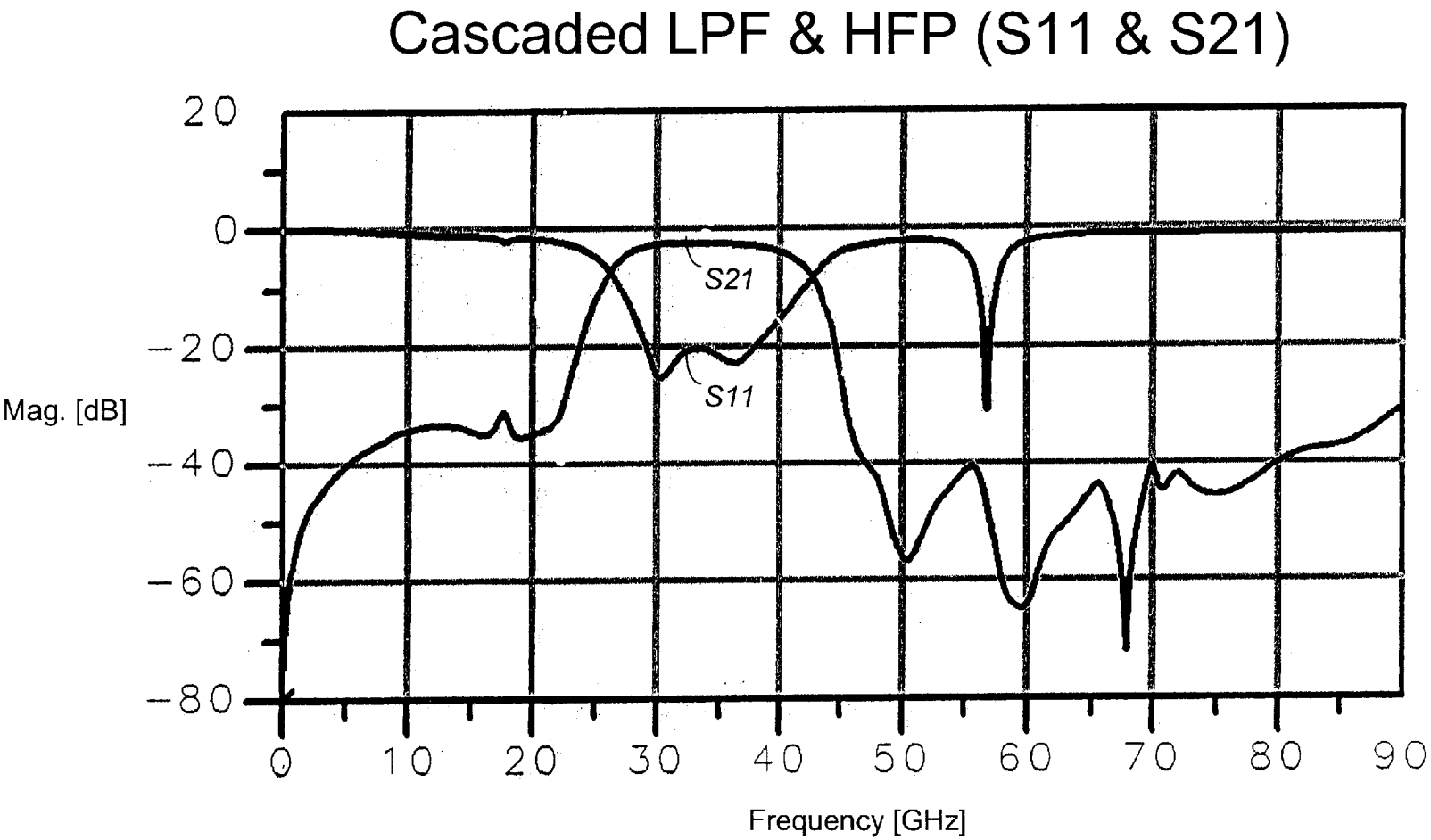
FIG. 5B illustrates a graph of an exemplary frequency response of the band-pass filter of the invention.

FIG. 5A illustrates a block diagram of an exemplary band-pass filter 500 in accordance with the invention. The band-pass filter 500 comprises a combination of one or more single-stage, low-pass filters 502-1-J of the type described with reference to single-stage, low-pass filter 100 and one or more single-stage, high-pass filters 504-1-K of the type described with reference to single-stage, high-pass filter 200. The combination of single-stage, low and high-pass filters 502-1-J and 502-1-K may be organized in a plurality of ways and may have respective transmission lines 506-1 to 506-(J+K−1) coupling consecutive stages of filters together. The respective parameters of the single-stage, low and high-pass filters 502-1-J and 504-1-K may be designed along with the respective parameters (lengths and characteristic impedances) of the transmission lines 506-1-(J+K−1) to achieve a desired overall frequency response for the band-pass filter 500. FIG. 5B illustrates a graph of an exemplary frequency response of the band-pass filter 500.

With respect to the low, high, and band-pass filters of the invention, the various transmission lines (input, output, meandered, and coupled) described may be formed of an electrical conductive material layer disposed on a substrate. Such electrical conductive material may include, for example, metallization layers, doped polycrystalline silicon, or other doped materials with sufficient electrical conductivity. Although the meandered transmission line is shown to include two or more coupled sections coupled respectively together by one or more transition transmission lines, it shall be understood that the meandered transmission line can be replaced with a single transmission line that is electromagnetically coupled to the series transmission line of the single-stage, low-pass filter or the series electromagnetically coupled transmission lines of the high-pass filter.

The substrate used on the low, high, band-pass, and other filters of the invention can be any dielectric substrate, such as those formed on ceramic, sapphire, quartz, and, fused silica, as well as semiconductor materials such as silicon, silicon-germanium, gallium-arsenide, indium-phosphide, etc. The filters may be configured into various transmission mediums such as microstrip, stripline, suspended stripline, co-planar waveguide, and other transmission mediums. The filters may be used in many applications in RF/microwave/millimeterwave technology. Below are a couple of examples of a transmitter and receiver that employ one or more of the filters in accordance with the invention.

Figure 6:
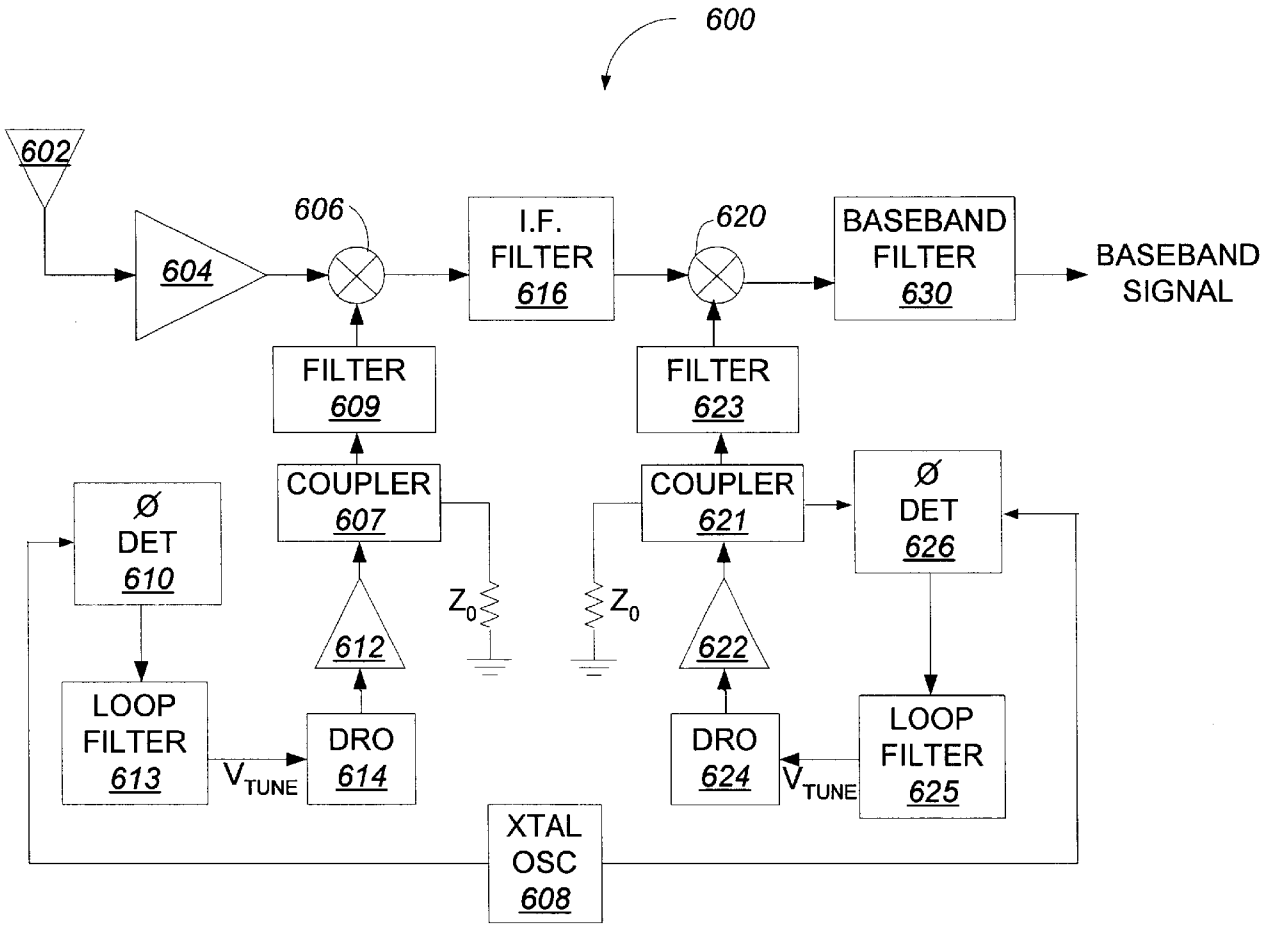
FIG. 6 illustrates a block diagram of an exemplary receiver in accordance with the invention.

FIG. 6 illustrates a block diagram of an exemplary receiver 600 using a band-pass filter in accordance with the invention. The filters of the invention can be used in many applications, even as part of the receiver 600. The receiver 600 comprises a low noise amplifier 604 having an input for receiving an RF/microwave/millimeterwave signal from an antenna 602 or other transmission source. The output of the low noise amplifier 604 is coupled to a first down-converting stage comprising a first mixer 606 and a first local oscillator (LO) comprising DRO 614, optional amplifier 612 (or other device that isolates the output of the DRO 614, such as an attenuator or isolator), a directional coupler 607, band-pass filter 609 (of the type described with reference to FIG. 5A), phase detector 610, a reference crystal oscillator 608, and a loop filter 613. The output of the DRO 614 is optionally coupled to the input of the amplifier 612 for isolating the output of the DRO 614. The coupler 610 couples a portion of the local oscillator signal at the output of the amplifier 612 to the phase detector 610 to phase compare the local oscillator signal with the reference from the crystal oscillator 608, and to generate a phase error signal. The phase error signal is applied to the loop filter 613 to generate a tuning voltage $V_{TUNE}$ for the DRO 614 to keep the DRO output within a frequency specification. The output of the coupler 607 is coupled to the band-pass filter 609 to remove harmonics, spurious, and other unwanted signals from the LO signal.

The output of the mixer 606 is coupled to an intermediate frequency (IF) filter 616 to remove the higher frequency products and other unwanted signals from the down-converted received signal. If two-stage downconversion is desired, the output of the IF filter 616 is coupled to a second down-converting stage comprising a second mixer 620 and a second local oscillator (LO) comprising DRO 624, optional amplifier 622 (or other device that isolates the output of the DRO 624, such as an attenuator or isolator), a directional coupler 621, band-pass filter 623 (of the type described with reference to FIG. 5A), a phase detector 626, the reference crystal oscillator 608 (being common to both down-converting stages), and a loop filter 625. The output of the DRO 624 is optionally coupled to the input of the amplifier 622 for isolating the output of the DRO 624. The coupler 621 couples a portion of the local oscillator signal at the output of the amplifier 622 to the phase detector 626 to phase compare the local oscillator signal with the reference from the crystal oscillator 608, and to generate a phase error signal. The phase error signal is applied to the loop filter 625 to generate the tuning voltage $V_{TUNE}$ for the DRO 624 to keep the DRO output within a frequency specification. The output of the coupler 621 is coupled to the band-pass filter 623 to remove harmonics, spurious, and other unwanted signals from the LO signal. The output of the mixer 620 is coupled to a baseband filter 630 to remove the higher frequency products and other unwanted signals from the second down-converted received signal to generate a baseband signal.

Figure 7:
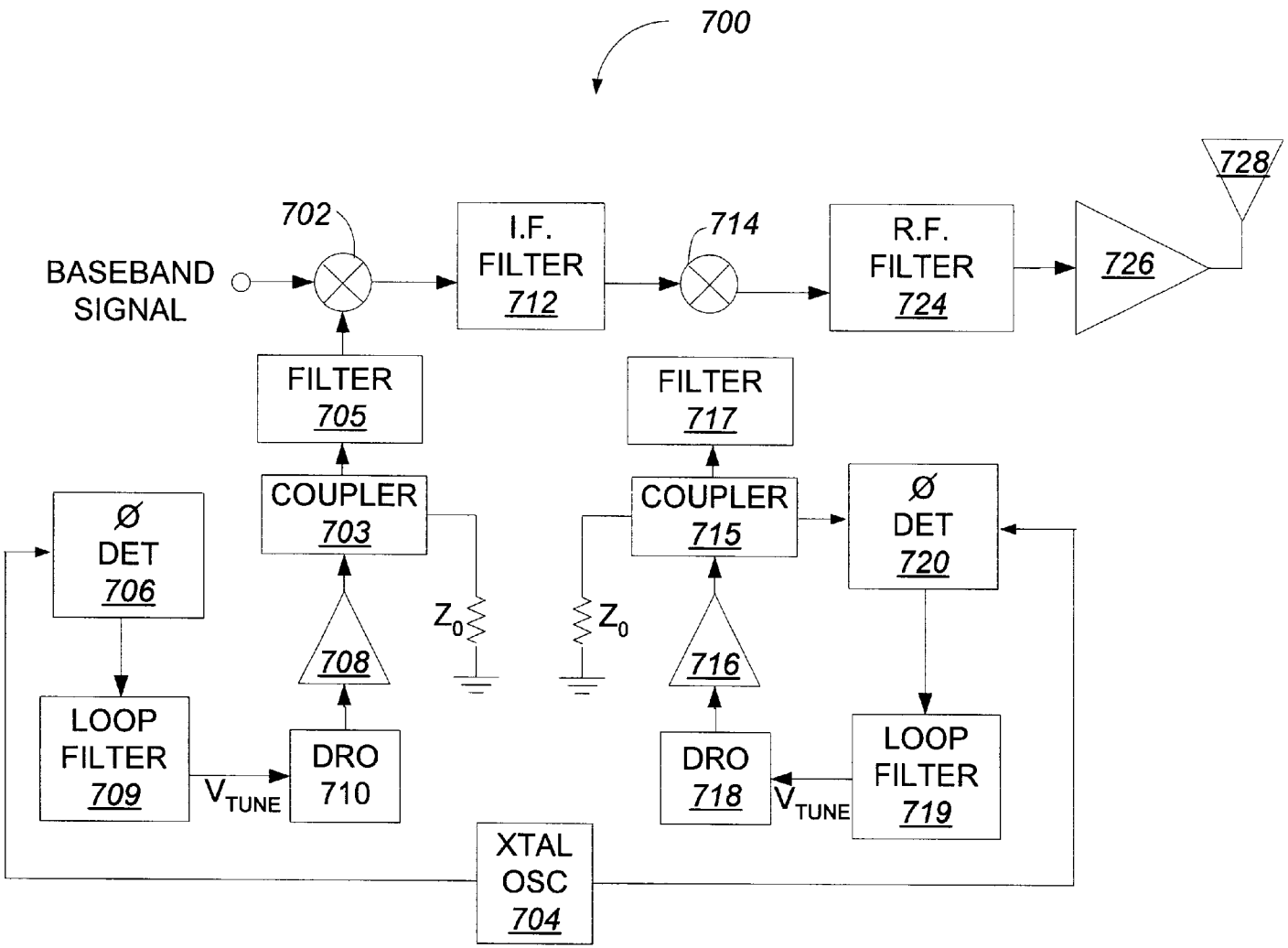
FIG. 7 illustrates a block diagram of an exemplary transmitter in accordance with the invention.

FIG. 7 illustrates a block diagram of an exemplary transmitter 700 using a band-pass filter in accordance with the invention. The filters of the invention can be used in many applications, even as part of the transmitter 700. The transmitter 700 comprises a first up-converting stage for upconverting a baseband signal. The first up-converting stage comprises a first mixer 702 and a first local oscillator (LO) comprising DRO 710, optional amplifier 708 (or other device that isolates the output of the DRO 710, such as an attenuator or isolator), a directional coupler 703, band-pass filter 705 (of the type described with reference to FIG. 5A), phase detector 706, a reference crystal oscillator 704, and a loop filter 709. The output of the DRO 710 is optionally coupled to the input of the amplifier 708 for isolating the output of the DRO 710. The coupler 703 couples a portion of the local oscillator signal at the output of the amplifier 708 to the phase detector 706 to phase compare the local oscillator signal with the reference from the crystal oscillator 704, and to generate a phase error signal. The phase error signal is applied to the loop filter 709 to generate a tuning voltage $V_{TUNE}$ for the DRO 710 to keep the DRO output within a frequency specification. The output of the coupler 703 is coupled to the band-pass filter 705 to remove harmonics, spurious, and other unwanted signals from the LO signal.

The output of the mixer 702 is coupled to an intermediate frequency (IF) filter 712 to remove the lower frequency products and other unwanted signals from the up-converted signal. If two-stage upconversion is desired, the output of the IF filter 712 is coupled to a second up-converting stage comprising a second mixer 714 and a second local oscillator (LO) comprising DRO 718, optional amplifier 716 (or other device that isolates the ouput of the DRO 718, such as an attenuator or isolator), a directional coupler 715, band-pass filter 717 (of the type described with reference to FIG. 5A), phase detector 720, the reference crystal oscillator 704 (being common to both up-converting stages), and a loop filter 719. The output of the DRO 718 is coupled to the input of the optional amplifier 716 for isolating the output of the DRO 718. The coupler 715 couples a portion of the local oscillator signal at the output of the amplifier 716 to the phase detector 720 to phase compare the local oscillator signal with the reference from the crystal oscillator 704, and to generate a phase error signal. The phase error signal is applied to the loop filter 719 to generate a tuning voltage $V_{TUNE}$ for the DRO 718 to keep the DRO output within a frequency specification. The output of the coupler 715 is coupled to the band-pass filter 717 to remove harmonics, spurious, and other unwanted signals from the LO signal.

The output of the mixer 714 is coupled to a high-pass filter 724 to remove the lower frequency products and other unwanted signals from the second up-converted signal to generate the RF/microwave/millimeterwave signal for transmission via a wireless medium or other transmission medium. The output of the high-pass filter 724 is coupled to the input of a power amplifier 726 (which can comprise of one or more amplification stages) for increasing the power of the RF/microwave/millimeterwave signal for transmission over the wireless medium via the antenna 728 or transmission over other types of transmission mediums.

In the foregoing specification, the invention has been described with reference to specific embodiments thereof. It will, however, be evident that various modifications and changes may be made thereto without departing from the broader spirit and scope of the invention. The specification and drawings are, accordingly, to be regarded in an illustrative rather than a restrictive sense.

What is claimed is:

1. A single-stage low pass filter, comprising:

a substrate;

an input transmission line formed on said substrate;

an output transmission line formed on said substrate;

a series transmission line formed on said substrate, wherein said series transmission line comprises a first end connected to said input transmission line and a second end connected to said output transmission line;

a first meandered transmission line comprising a first pair of coupled transmission lines and a transition transmission line connecting said first pair of coupled transmission lines together, wherein one of said first pair of coupled transmission lines is connected to said input transmission line, wherein said first meandered line comprises an open end; and a second meandered transmission line comprising a second pair of coupled transmission lines and a transition transmission line connecting said second pair of coupled transmission lines together, wherein one of said second pair of coupled transmission lines is connected to said output transmission line.

2. The single-stage, low-pass filter of claim 1, wherein a characteristic impedance of said series transmission line is greater than a characteristic impedance of either input or output transmission line.

3. The single-stage, low-pass filter of claim 1, wherein said characteristic impedance of said series transmission line is about 70 to 100 ohms.

4. The single-stage, low-pass filter of claim 3, wherein said characteristic impedance of either said input or said output transmission line is about 50 ohms.

5. The single-stage, low-pass filter of claim 1, wherein said first meandered transmission line is electromagnetically coupled to said series transmission line.

6. The single-stage, low-pass filter of claim 1, wherein said second meandered transmission line is electromagnetically coupled to said series transmission line.

7. The single-stage, low-pass filter of claim 1, wherein said second meandered transmission line comprises an open end.

8. A low-pass filter comprising two or more single-stage, low-pass filters as defined in claim 1.

9. A single-stage, high-pass filter, comprising:

a substrate;

an input transmission line formed on said substrate;

an output transmission line formed on said substrate;

a pair of series coupled transmission lines formed on said substrate, wherein one of said series coupled transmission lines is connected to said input transmission line and another of said series coupled transmission lines is connected to said output transmission line;

a first meandered transmission line comprising a first pair of coupled transmission lines and a transition transmission line connecting said first pair of coupled transmission lines together, wherein one of said first pair of coupled transmission lines is connected to said input transmission line; and a second meandered transmission line comprising a second pair of coupled transmission lines and a transition transmission line connecting said second pair of coupled transmission lines together, wherein one of said second pair of coupled transmission lines is connected to said output transmission line.

10. The single-stage, high-pass filter of claim 9, wherein a characteristic impedance of said series coupled transmission lines is greater than a characteristic impedance of either input or output transmission line.

11. The single-stage, high-pass filter of claim 9, wherein said characteristic impedance of said series coupled transmission lines is about 70 to 100 ohms.

12. The single-stage, high-pass filter of claim 11, wherein said characteristic impedance of either said input or said output transmission line is about 50 ohms.

13. The single-stage, high-pass filter of claim 9, wherein said first meandered transmission line is electromagnetically coupled to said series transmission line.

14. The single-stage, high-pass filter of claim 9, wherein said second meandered transmission line is electromagnetically coupled to said series transmission line.

15. The single-stage, high-pass filter of claim 9, wherein said first meandered transmission line comprises an open end.

16. The single-stage, high-pass filter of claim 9, wherein said second meandered transmission line comprises an open end.

17. A high-pass filter comprising two or more single-stage, high-pass filters as defined in claim 9.

18. A band-pass filter comprising:

at least one single-stage, low-pass filter comprising:

a substrate;

a first input transmission line formed on said substrate;

a first output transmission line formed on said substrate;

a first series transmission line formed on said substrate, wherein said first series transmission line comprises a first end connected to said first input transmission line and a second end connected to said first output transmission line;

a first meandered transmission line comprising a first pair of coupled transmission lines and a transition transmission line connecting said first pair of coupled transmission lines together, wherein one of said first pair of coupled transmission lines is connected to said first input transmission line; and a second meandered transmission line comprising a second pair of coupled transmission lines and a transition transmission line connecting said second pair of coupled transmission lines together, wherein one of said second pair of coupled transmission lines is connected to said first output transmission line; and at least one single-stage, high-pass filter comprising:

a second input transmission line formed on said substrate;

a second output transmission line formed on said substrate;

a pair of series coupled transmission lines formed on said substrate, wherein one of said series coupled transmission lines is connected to said second input transmission line and another of said series coupled transmission lines is connected to said second output transmission line;

a third meandered transmission line comprising a third pair of coupled transmission lines and a transition transmission line connecting said third pair of coupled transmission lines together, wherein one of said third pair of coupled transmission lines is connected to said second input transmission line; and a second meandered transmission line comprising a fourth pair of coupled transmission lines and a transition transmission line connecting said fourth pair of coupled transmission lines together, wherein one of said fourth pair of coupled transmission lines is connected to said second output transmission line.

* * * * *